United States Patent [19]

Pollmann et al.

[11] 3,942,143

[45] Mar. 2, 1976

[54] ELECTROMAGNETIC SWITCHING APPARATUS, PARTICULARLY MOTOR CONTACTOR, WITH AUXILIARY CONTACTS

[75] Inventors: Fritz Pollmann; Wilhelm Holzer, both of Amberg, Germany

[73] Assignee: Siemens Aktiengesellschaft, Munich, Germany

[22] Filed: Feb. 6, 1975

[21] Appl. No.: 547,438

[30] Foreign Application Priority Data

Feb. 14, 1974 Germany ..... 2407057

[52] U.S. Cl. ..... 335/132; 335/202

[51] Int. Cl.[2] ..... H01H 67/02

[58] Field of Search ..... 335/132, 202

[56] References Cited

UNITED STATES PATENTS 3,304,522 2/1967 Gribble et al. ..... 335/202

FOREIGN PATENTS OR APPLICATIONS 1,075,203 2/1960 Germany ..... 335/202

1,082,644 9/1967 United Kingdom ..... 335/132

*Primary Examiner*—G. Harris

*Attorney, Agent, or Firm*—Kenyon & Kenyon Reilly Carr & Chapin

[57] ABSTRACT

A switching apparatus of the kind in which contact bridges held in a contact bridge carrier in tiers, one behind the other, as seen in the switching direction, can be brought into contact with fixed contact members fastened to a single housing part. In particular, with the number of the bridges in the individual tiers uneven in number, the walls of the housing, which form at least in part the arcing chambers for the contact points of the contact members, extend into slots of the contact bridge carrier to form labyrinths and, at least one of said walls extends over only one tier. Additionally, the contact points of the upper tier are arranged, preferably, in recesses of the contact bridge carrier.

The present switching apparatus has the advantage that it permits accomodating in one molded housing, for instance, three main switch poles and four auxiliary switch poles.

5 Claims, 3 Drawing Figures

ELECTROMAGNETIC SWITCHING APPARATUS, PARTICULARLY MOTOR CONTACTOR, WITH AUXILIARY CONTACTS

BACKGROUND OF THE INVENTION

1. Field of the Invention

The invention concerns electromagnetic switching apparatus, particularly a motor contactor, with auxiliary contacts, with a contact bridge carrier and contact bridges held in the contact bridge carrier in tiers, one behind the other, as seen in the switching direction, the latter contact bridges being able to be brought into contact with fixed contact members which are attached to a housing part, and which are flanked by walls of the housing part which form at least in part the arcing chambers for the contact points and extend into slots of the contact bridge carrier forming labyrinths.

2. Description of the Prior Art

In one known motor contactor (German Auslegeschrift 1,024,151), the three main switch poles are disposed facing the attachment plane of the switching apparatus, and the actuating mechanism is disposed above the contact arrangement for the main switch poles, as seen from the attachment plane. Between the actuating mechanism and the main switch poles are situated small auxiliary switch blocks which are placed in the housing as a separate switching unit.

In another known electromagnetic switching apparatus design (German Auslegeschrift 1,237,668), four auxiliary switch poles are installed in the tier adjacent to the drive and, in a further auxiliary switch tier placed on top thereof, another four auxiliary switch poles are installed. The walls between the individual switch poles, which form the arcing chambers, are inserted into slots, and the contact bridge carrier likewise takes in the wall ends by means of slots. In this apparatus, electrically separating the individual auxiliary switch poles, which switch poles are disposed on top of each other, is possible only if the potential difference is small, as the contact bridges lie here in a window opening of the contact bridge carrier and there are no partitions between the fixed contact members. If such switching apparatus were used for a motor contactor, only three auxiliary switch poles associated with the main switch poles could be put on, if the width of the contactor is determined according to the main switch poles.

It is therefore an object of the present invention to create an electromagnetic switching apparatus of the kind mentioned above and, particularly, a motor contactor with auxiliary contacts, which ensures good potential separation of the individual switch poles from each other and which, at the same time, is of simple design.

SUMMARY OF THE INVENTION

In accordance with the principles of the present invention, the above and other objectives are accomplished in a simple manner by providing, in a switching apparatus of the above-described type, that the fixed contact members be held in one housing part and that, with the number of the bridges in the individual tiers being uneven, at least one wall of the housing extends over only one tier. Additionally, displacement of the main switch poles from the auxiliary poles, i.e., of the terminals relative to the axis of rotation of the screw elements, is achieved also in a simple manner by disposing the contact points of the tier facing away from the mounting plane in recesses of the contact bridge carrier. In the auxiliary switch poles, break and make contacts are advantageously provided alternatingly, so that the spacings between the fixed contact members become larger and, therefore, the potential separation better. Moreover, so that the potential separation can be improved further in the case of the center poles, where no continuous partition is provided, advantageously, the aforementioned wall extending over one tier is made to protrude, during the resetting motion of the contact bridge carrier, into a recess of the latter. In order to avoid flashover between the individual switch poles by escaping arc gases, the arcing chambers are advantageously closed transversely to the direction of motion of the contact bridge carrier and along their sides facing the terminals of the fixed contact members. To give the arc gases a chance to escape, in spite such configuration of the arcing chambers, particularly in the case of the main switch poles, it is further provided that the arcing chambers of the tier facing the mounting plane are vented by cutouts in the flanks, facing or extending toward the contact bridge, of constrictions in the housing which extend in the lengthwise direction of the contact bridge. The arc gases, after escaping into the open, are thereby deflected once more, so contact with foreign switch poles is practically impossible.

BRIEF DESCRIPTION OF THE DRAWING

An example of an embodiment according to the invention is described hereinbelow by making reference to the following drawing, in which.

DETAILED DESCRIPTION

It should be noted that the same parts have been labeled in all the figures with the same reference symbols.

Figure 1:
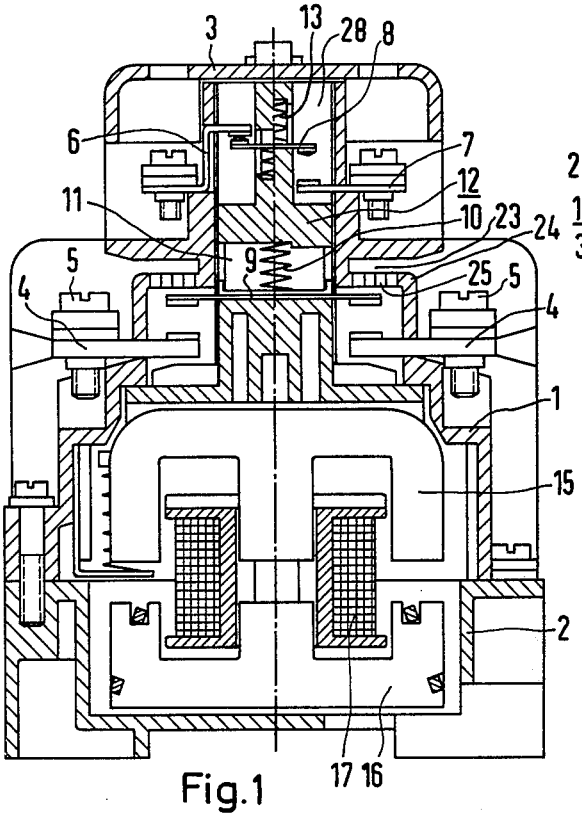
FIG. 1 shows a cross section of a side view of a switching apparatus in accordance with the present invention.

FIG. 1 shows an electromagnetic switching apparatus comprising a housing part 1 and a base part 2, the housing part 1 being closed off by a cover 3 which prevents dust from entering. As indicated, the fixed contact members for the three main switch poles of the apparatus are designated with a 4, the terminal screws therefor with a 5 and the fixed contact members for the auxiliary switch poles with a 6 and 7, respectively. The fixed contact members 7 cooperate with the contact bridges 8 as make contacts, and the fixed contact members 6 with the contact bridges 8 as break contacts. The contact bridges 9 for the main switch poles are held via contact pressure springs 10 in window-like openings 11 of the contact bridge carrier 12. The contact bridges 8 are supported via springs 13 in the window-like openings 14 (see FIG. 2) of the contact bridge carrier 12. The contact bridge carrier 12 is connected with the switching part 15 of a magnet, which is influenced by the non-switching magnet part 16 or the actuating coil 17, to which voltage can be applied.

Figure 2:
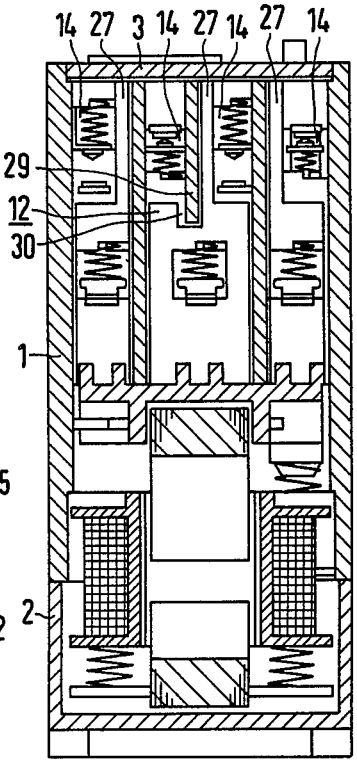
FIG. 2 shows a lateral cross section of the apparatus of FIG. 1.
Figure 3:
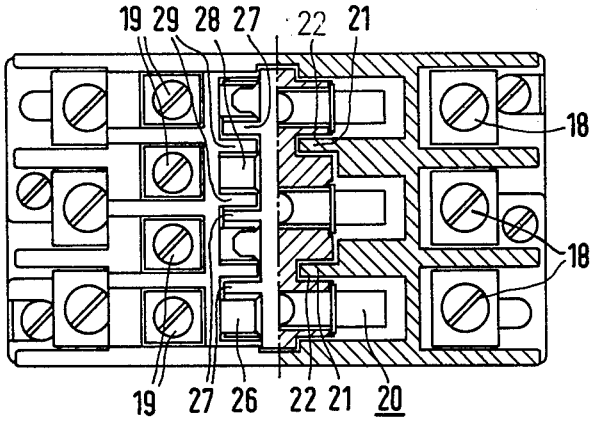
FIG. 3 illustrates a top view, partly in cross section, of the apparatus of FIG. 1 with the cover part thereof removed.

As shown more clearly in FIGS. 2 and 3, three main switch poles 18 and four auxiliary switch poles 19 are provided in the present illustrative embodiment of the switching apparatus. The arcing chambers 20 are bounded by the outer walls and, in addition, by walls 21 of the housing part 1, the latter walls 21 extending into slots 22 of the contact bridge carrier 12. On their side adjacent to the auxiliary switch poles 19, the arcing chambers 20 are separated from the auxiliary switch poles by constrictions 23 of the housing. On the flanks 24 facing or extending toward the contact bridge 9, the housing constrictions 23 have cutouts 25, which ensure that the arc gases can exit from the arcing chambers 20. The arcing chambers 26 for the auxiliary switch poles 19 are separated by barriers 27 of the contact carrier 12, of which two together always form a recess 28 and which, together with the barriers 29 of the housing part 1, form labyrinths. The center barrier 29 does not extend over the entire length of the contact bridge carrier 12, as is shown in FIG. 2, but extends into a recess 30 of the contact bridge carrier, when the contact bridge carrier 12 is in the rest position. Thereby, a lengthening of the flashover path between the individual poles of the switch is possible, the recess 30, together with the wall 29, likewise acting as a labyrinth.

It is thus possible with the switching apparatus design according to the invention to accommodate in one and the same housing three main switch poles and four auxiliary switch poles without the need for separate means for attaching auxiliary switch blocks or the like. The fixed contact members for the switch poles can be attached to the housing in the conventional manner. Flashover from the main switch poles is practically impossible.

What is claimed is:

1. An electromagnetic switching apparatus for use as a motor contactor comprising:

fixed contact members;

a contact bridge carrier having slots therein;

contact bridges held in said contact bridge carrier in tiers, one behind the other, as seen in the switching direction, said contact bridges being able to be brought into contact with said fixed contact members and being uneven in number in said tiers;

and a housing part to which said fixed contact members are attached, said housing having walls which form at least a part of the arcing chambers for the contact points of said fixed members and which extend into said slots to form labyrinths, at least one of said walls being such as to extend over only one of said tiers.

2. Apparatus in accordance with claim 1 in which:

said contact bridge has recesses therein;

the contact bridges of a first one of said tiers are mounted so as to face away from a mounting plane;

and the contact points of the bridges of said first tier are disposed in said recesses of said contact bridge carrier.

3. Apparatus in accordance with claim 2 in which:

said contact bridge has a further recess therein; and said wall extending over only one of said tiers protrudes into said further recess during the resetting motion of said contact bridge carrier.

4. Apparatus in accordance with claim 2 in which:

the contact bridges of a second one of said tiers are mounted so as to face toward said mounting plane;

the walls of said housing associated with the arcing chambers which correspond to the contact bridges of said second tier have constrictions therein extending in the lengthwise direction of said contact bridge carrier;

and the flanks of said constrictions facing said contact bridge carrier have cutouts for venting their respective arcing chambers.

5. Apparatus in accordance with claim 1 in which the walls of said housing associated with the arcing chambers which correspond to said fixed members close said arcing chambers transversely to the direction of motion of said contact bridge carrier and along the sides of said chambers facing the terminals of said fixed members.

* * * * *